US009366459B2

(12) United States Patent
Morie

(10) Patent No.: US 9,366,459 B2
(45) Date of Patent: Jun. 14, 2016

(54) CRYOGENIC REFRIGERATOR

(71) Applicant: SUMITOMO HEAVY INDUSTRIES, LTD., Tokyo (JP)

(72) Inventor: Takaaki Morie, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 130 days.

(21) Appl. No.: 14/191,539

(22) Filed: Feb. 27, 2014

(65) Prior Publication Data

US 2014/0318155 A1 Oct. 30, 2014

(30) Foreign Application Priority Data

Apr. 24, 2013 (JP) ..... 2013-091802

(51) Int. Cl.

| | |
|---|---|
| ***F25B 9/00*** | (2006.01) |
| ***F25B 9/02*** | (2006.01) |
| ***F25B 9/14*** | (2006.01) |
| *F25B 9/10* | (2006.01) |

(52) U.S. Cl.

CPC .... *F25B 9/14* (2013.01); *F25B 9/10* (2013.01)

(58) Field of Classification Search

CPC ..... F25B 9/00; F25B 9/06; F25B 9/09; F25B 9/14; F25B 2309/001

USPC ..... 74/603, 604, 595, 596

See application file for complete search history.

(56) References Cited

U.S. PATENT DOCUMENTS 2,802,437 A * 8/1957 Ayres ..... D05B 55/14 112/221
4,180,984 A * 1/1980 Chellis ..... F25B 9/14 60/522
4,333,755 A * 6/1982 Sarcia ..... F25B 9/14 137/625.37
4,446,701 A * 5/1984 Suzuki ..... F25B 9/14 60/520
5,361,588 A * 11/1994 Asami ..... F25B 9/14 60/520
5,525,047 A * 6/1996 Sternenberg ..... F04B 49/24 251/282
5,658,057 A * 8/1997 Ohnuma ..... B60T 8/175 303/116.2
5,832,906 A * 11/1998 Douville ..... F17C 5/06 123/527
2011/0061404 A1* 3/2011 Ishizuka ..... F25B 9/14 62/6
2012/0317994 A1* 12/2012 Matsubara ..... F25B 9/14 62/6

FOREIGN PATENT DOCUMENTS

JP 63-053469 3/1988
JP 2007-205582 8/2007

* cited by examiner

*Primary Examiner* — Frantz Jules
*Assistant Examiner* — Erik Mendoza-Wilkenfe
(74) *Attorney, Agent, or Firm* — IPUSA, PLLC

(57) ABSTRACT

A cryogenic refrigerator includes a compressor having a return end and a suction end that selectively connects to an expansion space, a housing having an assist space that communicates to the return end, a cylinder having one end connected to the housing and another end connected to the expansion space, a displacer that undergoes a reciprocating motion inside the cylinder, and tolerates flow of a working gas to and from the expansion space, and a drive shaft that is accommodated within the housing and drives the displacer. The drive shaft includes first and second parts having different cross sectional areas, sealed and supported by first and second seals, respectively. An end of the first part opposes the housing to form the assist space, and an end of the second part connects to the displacer.

8 Claims, 7 Drawing Sheets

CRYOGENIC REFRIGERATOR

RELATED APPLICATION

This application is based upon and claims the benefit of priority of Japanese Patent Application No. 2013-091802, filed on Apr. 24, 2013, the entire contents of which are incorporated herein by reference.

BACKGROUND

1. Technical Field

The present invention relates to a cryogenic refrigerator that uses a displacer.

2. Description of Related Art

Gifford-McMahon (GM) refrigerators are known as cryogenic refrigerators that use a displacer. The GM refrigerator causes a displacer to undergo a reciprocating motion within a cylinder, in order to vary a volume of an expansion space. Cooling is generated in the expansion space, by selectively connecting the expansion space to a return end and a suction end of the compressor in correspondence with this volume variation.

In a certain GM refrigerator, a drive shaft that drives the displacer is accommodated within a housing, and the pressure within a space (or assist space) formed at a tip end part of the drive shaft and the housing are adjusted.

SUMMARY

According to an embodiment of the present invention, there is provided a cryogenic refrigerator including a compressor having a return end and a suction end that selectively connects to an expansion space, a housing having an assist space that communicates to the return end, a cylinder having one end connected to the housing and another end connected to the expansion space, a displacer that undergoes a reciprocating motion inside the cylinder, and tolerates flow of a working gas to and from the expansion space via a gas channel provided inside the displacer, and a drive shaft that is accommodated within the housing and drives the displacer, wherein the drive shaft includes a first shaft part that is sealed and supported by a first seal member, and a second shaft part that is sealed and supported by a second seal member, the first shaft part has an end opposing the housing to form the assist space, the second shaft part has an end connecting to the displacer, and the first shaft part and the second shaft part have cross sectional areas that are mutually different.

Other objects and further features of the present invention will be apparent from the following detailed description when read in conjunction with the accompanying drawings.

DETAILED DESCRIPTION

Figure 1:
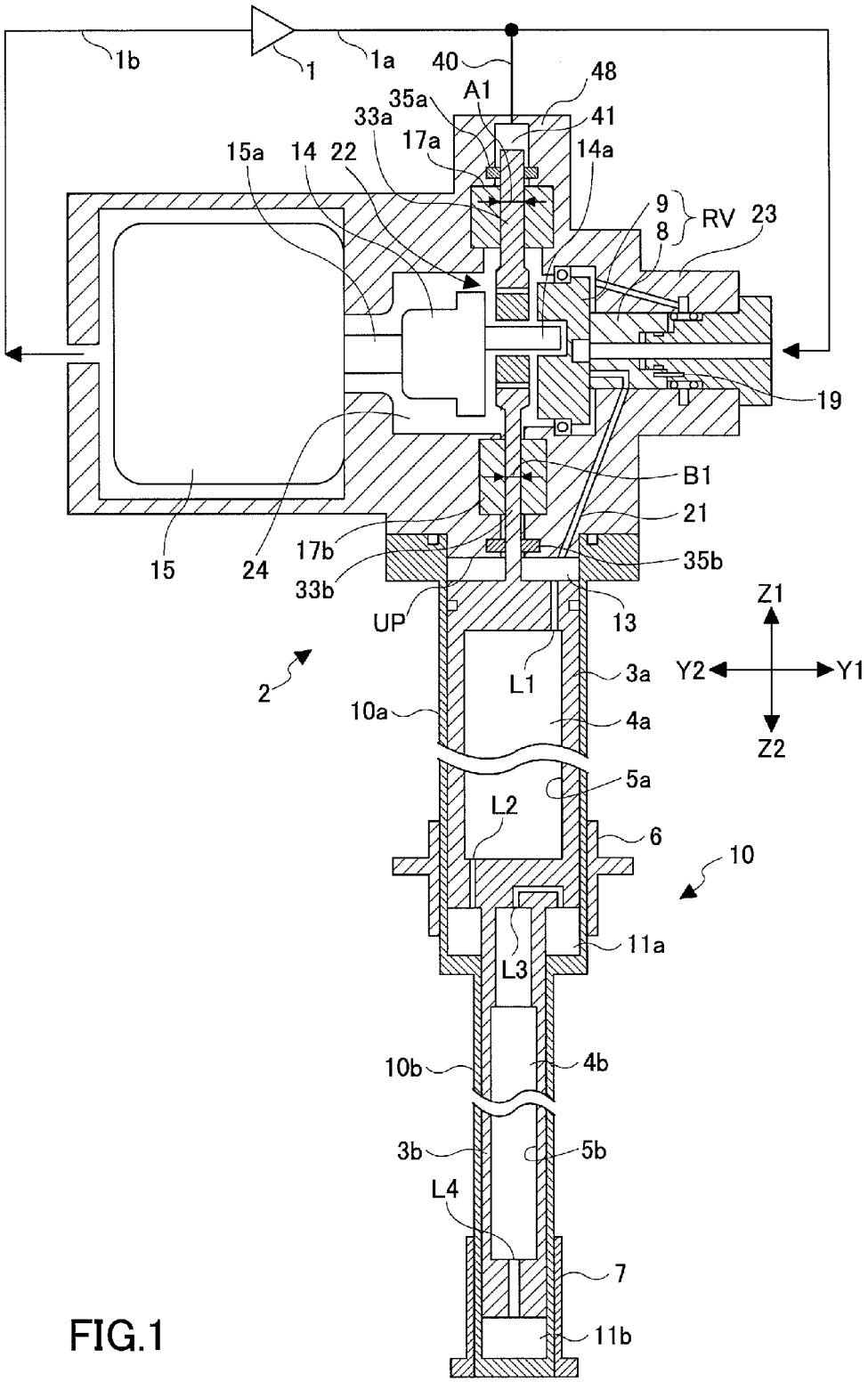
FIG. 1 is a cross sectional view illustrating a GM refrigerator in one embodiment of the present invention.

A cooling capability required of the cryogenic refrigerator differs depending on the usage thereof. A torque required to drive the displacer tends to increase according to an increase in the required cooling capability. However, increasing a capacity of a motor that is used as a driving source is not preferable from a standpoint of not increasing the size of the structure and not increasing power consumption.

On the other hand, the GM refrigerator may be used to cool an apparatus, such as high-temperature superconducting equipment, for example, that is required to have a high cooling capability. When the GM refrigerator is put to such use, the pressure adjustment of the above described assist space may not be able to sufficiently suppress the required driving torque.

Accordingly, there is a need for a cryogenic refrigerator that can reduce the torque required to drive the displacer, without increasing the size of the structure.

A description will be given of embodiments of the present invention, by referring to the drawings.

FIG. 1 is a cross sectional view illustrating a cryogenic refrigerator in one embodiment of the present invention. In this embodiment, a Gifford-McMahon (GM) refrigerator is described as an example of the cryogenic refrigerator, however, the present invention is not limited to the GM refrigerator.

The GM refrigerator illustrated in FIG. 1 includes a gas compressor 1 and a cold head 2. The cold head 2 includes a housing 23 and a cylinder part 10.

The gas compressor 1 sucks a working gas from a suction port to which a return pipe 1*b* is connected, compresses the working gas, and thereafter supplies a high-pressure working gas to a supply pipe 1*a* that is connected to a discharge (return) port. Helium gas may be used for the working gas.

This embodiment illustrates a two-stage GM refrigerator as the cryogenic refrigerator. The two-stage GM refrigerator has the cylinder part 10 including two cylinders, namely, a first-stage cylinder 10*a* and a second-stage cylinder 10*b*.

A first-stage displacer 3*a* is inserted inside the first-stage cylinder 10*a*. In addition, a second-stage displacer 3*b* is inserted inside the second-stage cylinder 10*b*.

The first-stage displacer 3*a* and the second-stage cylinder 3*b* are mutually connected. The first-stage displacer 3*a* has a structure capable of undergoing a reciprocating motion in an axial direction (directions indicated by arrows Z1 and Z2 in FIG. 1) of the cylinder part 10, inside the first-stage cylinder 10*a*. The second-stage displacer 3*b* has a structure capable of undergoing a reciprocating motion in the axial direction of the cylinder part 10, inside the second-stage cylinder 10*b*. In this embodiment, the axial direction of the cylinder part 10 may be simply referred to as the "axial direction". For the sake of convenience, a position along the axial direction that is near relative to an expansion space or a cooling stage may be referred to as being "lower", and a position along the axial direction that is far relative to the expansion space or the cooling stage may be referred to as being "upper". In other words, the position that is far relative to a low-temperature end may be referred to as being "upper", and the position that is near relative to the low-temperature end may be referred to as being "lower". Such representations of the positions are unrelated to an arrangement employed when mounting the GM refrigerator. For example, the GM refrigerator may be mounted vertically with the expansion space facing upwards.

Gas channels 5*a* and 5*b* are formed inside the first-stage and second-stage displacers 3*a* and 3*b*, respectively. Regenerator materials 4*a* and 4*b* are provided inside the gas channels 5*a* and 5*b*, respectively. The working gas passes through the gas channels 5*a* and 5*b* while making heat exchanges with the regenerator materials 4*a* and 4*b*.

In addition, the first-stage displacer 3*a* that is located on the upper part is connected to a lower drive shaft 33*b* that protrudes towards the upper side (Z1 direction). This lower drive shaft 33*b* is a part of a Scotch yoke mechanism 22 that will be described later.

A first-stage expansion chamber 11*a* is formed on the low-temperature end of the first-stage cylinder 10*a*. More particularly, the first-stage expansion chamber 11*a* is formed between the low-temperature end of the first-stage displacer 3*a* and a bottom surface of the first-stage cylinder 10*a*.

In addition, an upper chamber 13, that provides a space to tolerate motions of the first-stage and second-stage displacers 3*a* and 3*b*, is formed on a high-temperature end (end on the side of the direction indicated by the arrow Z1 in FIG. 1) of the first-stage cylinder 10*a*. The upper chamber 13 may form a part of a channel that flows gas to and from the insides the first-stage and second-stage displacers 3*a* and 3*b*.

Furthermore, a second-stage expansion chamber 11*b* is formed on the low-temperature end of the second-stage cylinder 10*b*. More particularly, the second-stage expansion chamber 11*b* is formed between the low-temperature end of the second-stage cylinder 10*b* and a bottom surface of the second-stage cylinder 10*b*.

The upper chamber 13 and the first-stage expansion chamber 11*a* are connected via a gas channel L1, a first-stage gas channel 5*a*, and a gas channel L2. The gas channel. L1 is formed on the upper part of the first-stage displacer 3*a*. In addition, the gas channel L2 is formed on the lower part of the first-stage displacer 3*a*.

In addition, the first-stage expansion chamber 11*a* and the second-stage expansion chamber 11*b* are connected via a gas channel L3, a second-stage gas channel 5*b*, and a gas channel L4. The gas channel L3 is formed on the upper part of the second-stage displacer 3*b*, and the gas channel L4 is formed on the lower part of the second-stage displacer 3*b*.

A first-stage cooling stage 6 is mounted on an outer peripheral surface of the first-stage cylinder 10*a* at a position opposing the first-stage expansion chamber 11*a*. In addition, a second-stage cooling stage 7 is mounted on an outer peripheral surface of the second-stage cylinder 10*b* at a position opposing the second-stage expansion chamber 11*b*.

The first-stage and second-stage displacers 3*a* and 3*b* are driven by the Scotch yoke mechanism 22.

Figure 2:
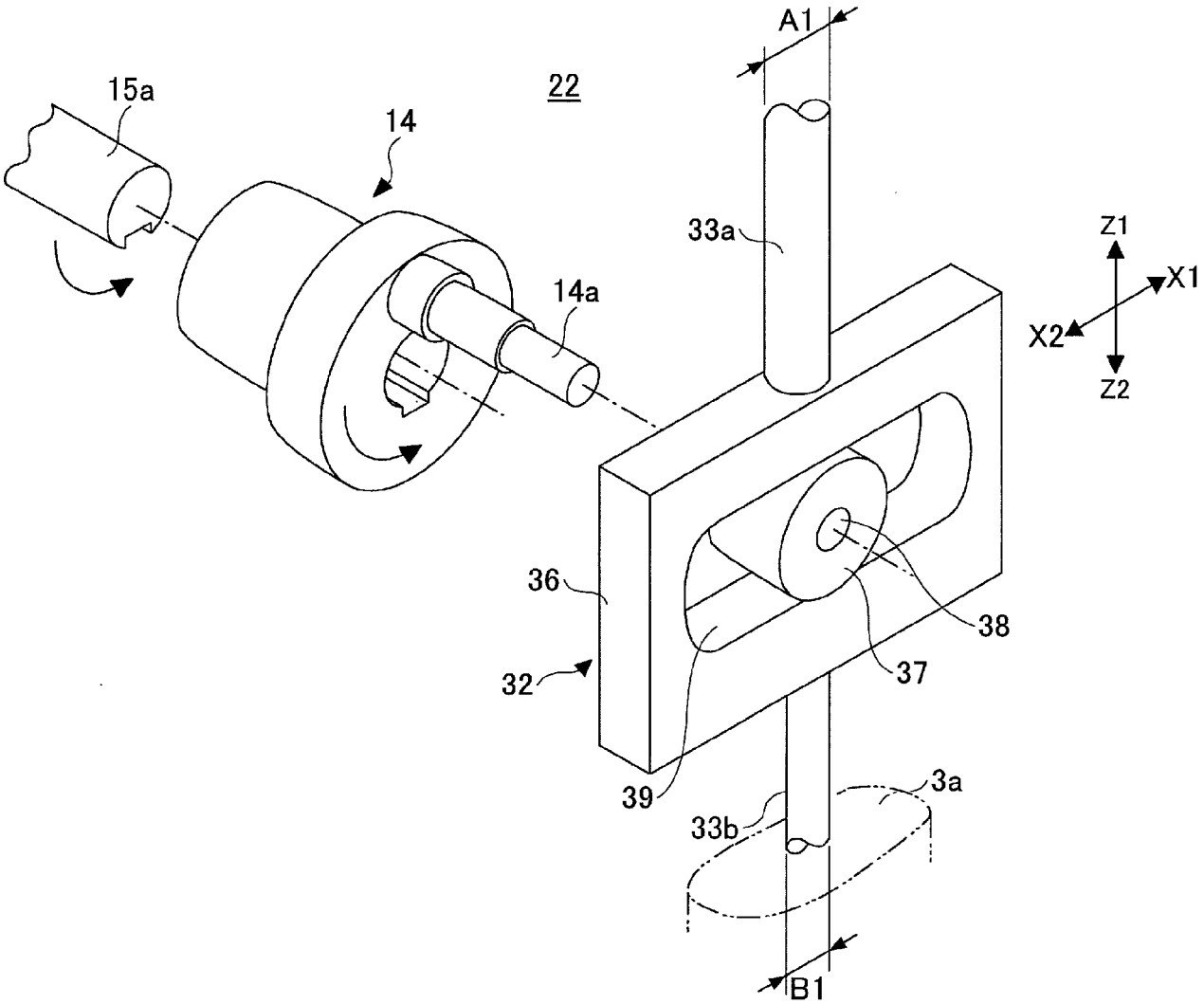
FIG. 2 is a diagram illustrating a Scotch yoke mechanism on an enlarged scale.

FIG. 2 is a diagram illustrating the Scotch yoke mechanism 22 on an enlarged scale.

The Scotch yoke mechanism 22 is provided within a drive mechanism accommodating chamber 24 that is formed in the housing 23. This Scotch yoke mechanism 22 includes a crank 14 and a Scotch yoke 32. The drive mechanism accommodating chamber 24 communicates to the suction port of the gas compressor 1 via the return pipe 1*b*. For this reason, the drive mechanism accommodating chamber 24 is constantly maintained at a low pressure that is approximately on the same order as the pressure at the suction port.

The crank 14 is fixed to a rotating shaft (hereinafter referred to as a "drive rotating shaft 15*a*") of a motor 15. This crank 14 includes an eccentric pin 14*a* that is located at an eccentric position from the center of the drive rotating shaft 15*a*. Accordingly, when the crank 14 is mounted on the drive rotating shaft 15*a*, the eccentric pin 14*a* becomes eccentric with respect to the drive rotating shaft 15*a*.

The Scotch yoke 32 includes an upper drive shaft 33*a*, a lower drive shaft 33*b*, a yoke plate 36, a roller bearing 37, and the like.

The upper drive shaft 33*a* is provided to protrude towards the upper part (Z1 direction) from an upper central position of the yoke plate 36. This upper drive shaft 33*a* is supported on a bearing 17*a* that is provided within the housing 23. A space for tolerating motion of the drive shaft 33*a* is provided on the upper part of the upper drive shaft 33*a*. This space may also function as an assist chamber 41 (assist part 48) that will be described later. In other words, a part of the upper end of the upper drive shaft 33*a* is inserted into the assist chamber 41.

In addition, the lower drive shaft 33*b* is provided to protrude towards the lower part (Z2 direction) from a lower central position of the yoke plate 36. This lower drive shaft 33*b* is supported on a bearing 17*b* that is provided within the housing 23.

Accordingly, the Scotch yoke 32 may undergo a reciprocating motion in upward and downward directions (directions of the arrows Z1 and Z2 in FIGS. 1 and 2) within the housing 23, because the drive shafts 33*a* and 33*b* are supported by the bearings 17*a* and 17*b*, respectively.

In addition, the yoke plate 36 includes a horizontally elongated window 39. This horizontally elongated window 39 extends in directions (directions of arrows X1 and X2 in FIG. 2) perpendicular to both the drive rotating shaft 15*a* and the directions in which the upper and lower drive shafts 33*a* and 33*b* protrude.

The roller bearing 37 is rotatably arranged within the horizontally elongated window 39. In addition, an engaging hole 38 that engages the eccentric pin 14*a* is formed at a center position of the roller bearing 37.

Accordingly, when the motor 15 is driven and the drive rotating shaft 15*a* is rotated, the eccentric pin 14*a* rotates in a circle. Hence, the Scotch yoke 32 undergoes a reciprocating motion in the directions of the arrows Z1 and Z2 in FIG. 2, as the drive rotating shaft 15*a* rotates. In this state, the roller bearing 37 undergoes a reciprocating motion in the directions of the arrows X1 and X2 in FIG. 2 within the horizontally elongated window 39.

The lower drive shaft 33*b* arranged on the lower part of the Scotch yoke 32 is connected to the first-stage displacer 3*a*. Hence, when the Scotch yoke 32 undergoes a reciprocating motion in the directions of the arrows Z1 and Z2 in FIG. 2, the first-stage displacer 3*a* and the second-stage displacer 3*b* that is connected to the first-stage displacer 3*a* undergo reciprocating motions in the directions of the arrows Z1 and Z2 within the first-state cylinder 10*a* and the second-stage cylinder 10*b*, respectively.

As described above, the Scotch yoke mechanism 22 is driven by the motor 15. For this reason, when a load is applied on each of the first-stage and second-stage displacers 3*a* and 3*b*, a motor load torque is applied onto the motor 15 via the Scotch yoke mechanism 22.

The housing 23 includes the assist part 48 at a position corresponding to the upper drive shaft 33*a*. An assist chamber 41 is formed inside this assist part 48.

This assist chamber 41 is the space formed between the upper end of the upper drive shaft 33*a* and the housing 23. The part of the upper end of the upper drive shaft 33*a* is movable in the directions of the arrows Z1 and Z2 in FIGS. 1 and 2, within the assist chamber 41.

An upper seal 35*a* seals and isolates the drive mechanism accommodating chamber 24 and the assist chamber 41. The upper seal 35*a* is arranged between the housing 23 and the upper drive shaft 33*a*, and supports the upper drive shaft 33*a*. For example, a slipper seal, a clearance seal, or the like may be used for the upper seal 35*a*. The bearing 17*a* and the upper seal 35*a* may also function as the upper seal 35*a*.

In addition, the upper drive shaft 33*a* penetrates the upper seal 35*a* and extends from the drive mechanism accommodating chamber 24 to the assist chamber 41. The upper seal 35*a* is thus configured to tolerate the movement of the upper drive shaft 33, and to maintain the seal between the drive mechanism accommodating chamber 24 and the assist chamber 41.

The assist chamber 41 is connected to the supply pipe 1*a* of the gas compressor 1 via a branching pipe 40. Hence, the assist chamber 41 is supplied with the high-pressure working gas from the gas compressor 1.

In the example illustrated in FIG. 1, the working gas from the gas compressor 1 is supplied to the assist chamber 41 via the branching pipe 40 that is arranged externally to the housing 23.

However, a supply pipe may be formed inside the housing 23, and this supply pipe may be used to supply, to the assist chamber 41, the high-pressure working gas that is supplied from the gas compressor 1 to a rotary valve RV.

Next, a description will be given of a valve mechanism by FIG. 1.

The valve mechanism is provided at an intermediate part of a flow path of the working gas, extending from the gas compressor 1 and reaching the upper chamber 13. This valve mechanism includes a supply valve V1 that guides the high-pressure working gas discharged from the gas compressor 1 into the expansion space via the upper chamber 13, and a return valve V2 that returns the working gas from the expansion space to the gas compressor 1 via the upper chamber 13.

In this embodiment, the rotary valve RV is used as an example of the valve mechanism. However, the valve mechanism is not limited to the rotary valve, and for example, a spool valve mechanism, a valve mechanism using an electronically controlled solenoid valve, or the like may be used for the valve mechanism.

The rotary valve includes a stator valve 8 and a rotor valve 9.

The rotor valve 9 is rotatably supported within the housing 23. On the other hand, the stator valve 8 is fixed to the housing 23 by a pin 19 so as not to rotate.

The eccentric pin 14*a* of the Scotch yoke mechanism 22 is connected to the rotor valve 9. Hence, when the eccentric pin 14*a* rotates as the motor 15 rotates, the rotor valve 9 rotates with respect to the stator valve 8.

In addition, the housing 23 includes a gas channel 21. This gas channel 21 has one end thereof connected to the upper chamber 13, and another end thereof connected to the rotary valve RV.

When the supply valve V1 opens as the rotor valve 9 rotates, the high-pressure working gas from the gas compressor 1 is supplied to the upper chamber 13 via the gas channel 21. On the other hand, when the return valve V2 opens as the rotor valve 9 rotates, cooling is generated. Further, when the cooling is generated and the pressure of the working gas becomes low, the working gas is returned from the upper chamber 13 to the gas compressor 1 via the gas channel 21.

A supply (suction) operation to supply the working gas to the upper chamber 13, and a return (discharge) operation to return the working gas from the upper chamber 13 are repeated as the rotary valve 9 is rotated by the motor 15. The working gas supply and return (suction and discharge) operations that are repeated, and the reciprocating motions of the first-stage and second-stage displacers 3*a* and 3*b* are both synchronized to the rotation of the crank 14.

Accordingly, the working gas inside the first-stage and second-stage expansion chambers 11*a* and 11*b* expands and the cooling is generated, by suitably adjusting a phase of the repetition of the working gas supply and return operations and a phase of the reciprocating motions of the first-stage and second-stage displacers 3*a* and 3*b*.

Next, a description will be given on the configuration of the upper drive shaft 33*a* and the lower drive shaft 33*b* that are provided in the Scotch yoke mechanism 22. A description will be given of an assist force acting on the Scotch yoke mechanism 22 by provision of the assist chamber 41.

Figure 3:
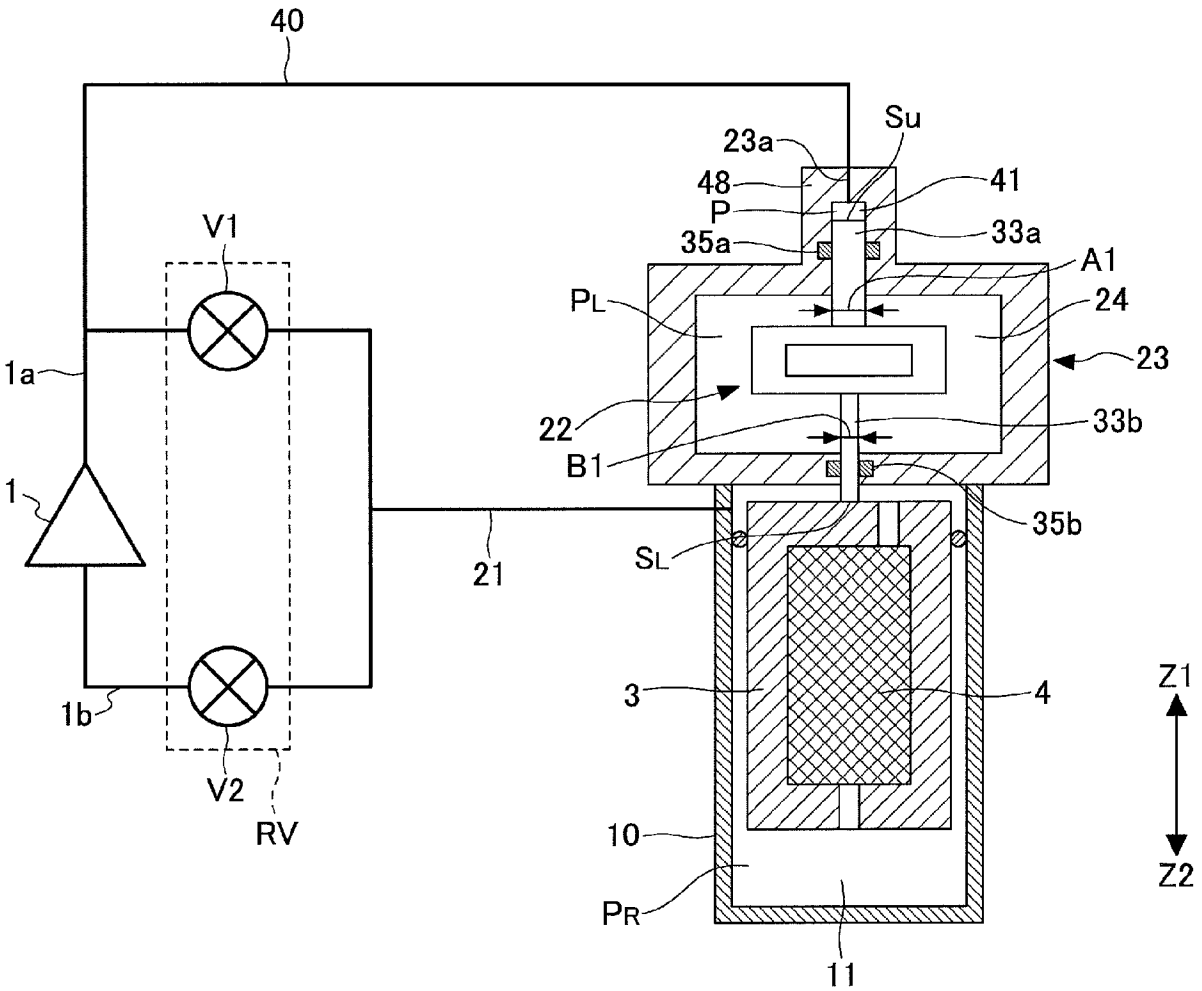
FIG. 3 is a schematic diagram illustrating a configuration of the GM refrigerator in one embodiment of the present invention.

In the following, a description will be given by referring to FIG. 3, which illustrates a basic configuration of the GM refrigerator illustrated in FIG. 1. FIG. 3 illustrates a single-stage GM refrigerator for the sake of convenience, in order to simplify the drawing and the description thereof. In addition, the supply valve V1 and the return valve V2 of the rotary valve RV are illustrated in a simplified manner in FIG. 3. Furthermore, the illustration of the crank 14, the eccentric pin 14*a*, the motor 15, the roller bearing 37, and the like is omitted in FIG. 3.

FIG. 3 illustrates a state in which the displacer 3 moves within the cylinder part 10 and the volume of the expansion chamber 11 becomes a maximum. When moving the displacer 3 in the downward direction (in the direction of the arrow Z2) from this state, the supply valve V1 is closed and the return valve V2 is opened. As a result, the working gas inside the expansion chamber 11 passes through the regenerator material 4 arranged within the displacer 3, and thereafter passes through the gas channel 21, the rotary valve RV (return valve V2), and the like to flow into the suction port of the gas compressor 1.

The regenerator material 4 is arranged with a high density within the displacer 3, in order to increase the cooling efficiency. Hence, there is a large pressure loss when the working gas passes through the regenerator material 4. A load applied on the displacer 3 due to this pressure loss is transmitted to the Scotch yoke mechanism 22 via the lower drive shaft 33*b*, and the motor load torque is thereby applied onto the motor 15 that drives this Scotch yoke mechanism 22.

Accordingly, due to the pressure loss that occurs when the working gas passes through the regenerator material 4, a large motor load torque is temporarily applied onto the motor 15. When the motor load torque applied onto the motor 15 becomes greater than or equal to a threshold value, slipping is generated in the motor 15, and a normal cycle operation of the refrigerator may no longer be possible, as described above.

On the other hand, according to the GM refrigerator in this embodiment, the assist chamber 41 is formed inside the housing 23. In addition, the upper drive shaft 33*a* is inserted inside this assist chamber 41 in a state movable in the moving directions (directions of the arrows Z1 and Z2 in FIGS. 1 and 2) of the displacer 3.

In addition, the branching pipe 40 is connected to the assist chamber 41. The branching pipe 40 branches the supply pipe 1*a* that connects the gas compressor 1 and the supply valve V1. Accordingly, the high-pressure working gas generated from the gas compressor 1 is supplied to the assist chamber 41 via the branching pipe 40.

However, the assist chamber 41 and the drive mechanism accommodating chamber 24 are sealed and partitioned by the upper seal 35*a*. In addition, the upper seal 35*a* suppresses a leak of the high-pressure working gas from the assist chamber 41 to the drive mechanism accommodating chamber 24.

Therefore, when the high-pressure working gas is supplied from the gas compressor 1 to the assist chamber 41, the upper drive shaft 33*a* is applied with a load that forces the upper drive shaft 33*a* in the downward direction, due to a pressure difference between the assist chamber 41 and the drive mechanism accommodating chamber 24. As described above, the upper drive shaft 33*a* is connected to the displacer 3 via the Scotch yoke mechanism 22. For this reason, the displacer 3 is forced to move in the downward direction (in the direction that reduces the volume of the expansion chamber 11) due to the pressure of the working gas supplied to the assist chamber 41.

In other words, the pressure of the working gas supplied to the assist chamber 41 acts as the assist force that assists the downward movement of the displacer 3 when the displacer 3 is forced by the Scotch yoke mechanism 22 to move in the downward direction. By applying this assist force at appropriate timings, the motor load torque applied onto the motor 15 may be reduced.

Therefore, according to the GM refrigerator in this embodiment, the motor load torque can be reduced by the working gas supplied to the assist chamber 41. For this reason, even in a case in which the pressure loss of the working gas flowing through the regenerator material 4 is large, a large motor load torque can be prevented from being temporarily generated and applied onto the motor 15.

Next, a description will be given of a diameter (indicated by A1 in FIGS. 1 to 3) of the upper drive shaft 33*a* passing through the upper seal 35*a*, and a diameter (indicated by B1 in FIGS. 1 to 3) of the lower drive shaft 33*b* passing through the lower seal 35*b*.

In this embodiment, the diameter A1 of the upper drive shaft 33*a* passing through the upper seal 35*a* and the diameter B1 of the lower drive shaft 33*b* passing through the lower seal 35*b* are mutually different (A≠B). In the example illustrated in FIG. 3, the diameter A1 of the upper drive shaft 33*a* is set greater than the diameter B1 of the lower drive shaft 33*b* (A1>B1).

Next, the force acting on the Scotch yoke 32 will be considered for the case in which the diameters (cross sectional areas) of the upper drive shaft 33*a* and the lower drive shaft 33*b* are set to be mutually different.

An assist space pressure of the assist chamber 41 when the high-pressure working gas from the gas compressor 1 is supplied thereto is denoted by P, a housing chamber pressure of the drive mechanism accommodating chamber 24 is noted by $P_L$, and a cylinder internal pressure inside the cylinder part 10 is noted by $P_R$. In addition, an upper cross sectional area of the upper drive shaft 33*a* passing through the upper seal 35*a* is denoted by $S_U$, and a lower cross sectional area of the lower drive shaft 33*b* passing through the lower seal 35*b* is denoted by $S_L$.

By denoting the assist force acting on the Scotch yoke 32 by F, this assist force F may be represented by the following formula (1), where the downward direction (direction of the arrow Z2) is presented by a positive value.

$$F=(P-P_L)\times S_U-(P_R-P_L)\times S_L \quad (1)$$

The assist space pressure P, the housing chamber pressure $P_L$, and the cylinder internal pressure $P_R$ are generally determined by the operating conditions, cooling performance, pressure specifications, and the like of the GM refrigerator, and are difficult to change. On the other hand, the upper cross sectional area $S_U$ of the upper drive shaft 33*a* and the lower cross sectional area $S_L$ of the lower drive shaft 33*b* may be changed in a relatively easy manner regardless of the operating conditions, cooling performance, and the like of the GM refrigerator.

Accordingly, by appropriately setting the upper cross sectional area $S_U$ and the lower cross sectional area $S_L$, the assist force F can be adjusted without changing each of the assist space pressure P, the housing chamber pressure $P_L$, and the cylinder internal pressure $P_R$.

That is, values of the assist space pressure P, the housing chamber pressure $P_L$, and the cylinder internal pressure $P_R$ in the formula (1) above are determined by the operating conditions of the FM refrigerator, as described above.

In addition, from the formula (1) above, it is seen that the assist force F increases when the upper cross sectional area $S_U$ is increased with respect to the lower cross sectional area $S_L$. On the other hand, in a case in which the diameter A1 of the upper drive shaft 33*a* is set smaller than the diameter B1 of the lower drive shaft 33*b* (A1<B1), it is seen from the formula (1) above that the assist force F decreases.

Accordingly, the assist force F applied on the Scotch yoke 32 can be adjusted by making the diameters (cross sectional areas) of the upper and lower drive shafts 33*a* and 33*b* mutually different. In addition, the diameters (cross sectional areas) of the upper and lower drive shafts 33*a* and 33*b* can be set regardless of the cooling capability required of the GM refrigerator.

On the other hand, the magnitude of the pressure loss of the working gas flowing through the regenerator material 4, that is a main cause for temporarily generating a large motor load torque onto the motor 15, may vary depending on the cooling capability and the like of the GM refrigerator. More particularly, the pressure loss may vary depending on the diameters of the first-stage and second-stage displacers 3*a* and 3*b* and the gas channels 5*a* and 5*b*, whether the GM refrigerator is a single-stage GM refrigerator or a multi-stage GM refrigerator, types and densities of the regenerator materials 4*a* and 4*b* provided in the first-stage and second-stage displacers 3*a* and 3*b*, and the like.

Accordingly, the assist force F may be optimized to conform to the cooling capacity and the like of the GM refrigerator, in order to suppress a large motor load torque temporarily applied onto the motor 15.

According to the GM refrigerator in this embodiment, the assist force F applied on the Scotch yoke 32 is optimized by setting the diameters (cross sectional areas) of the upper and lower drive shafts 33*a* and 33*b* to be mutually different. As a result, according to the GM refrigerator in this embodiment, it is possible to effectively prevent a large motor load torque from being temporarily applied onto the motor 15.

Figure 4:
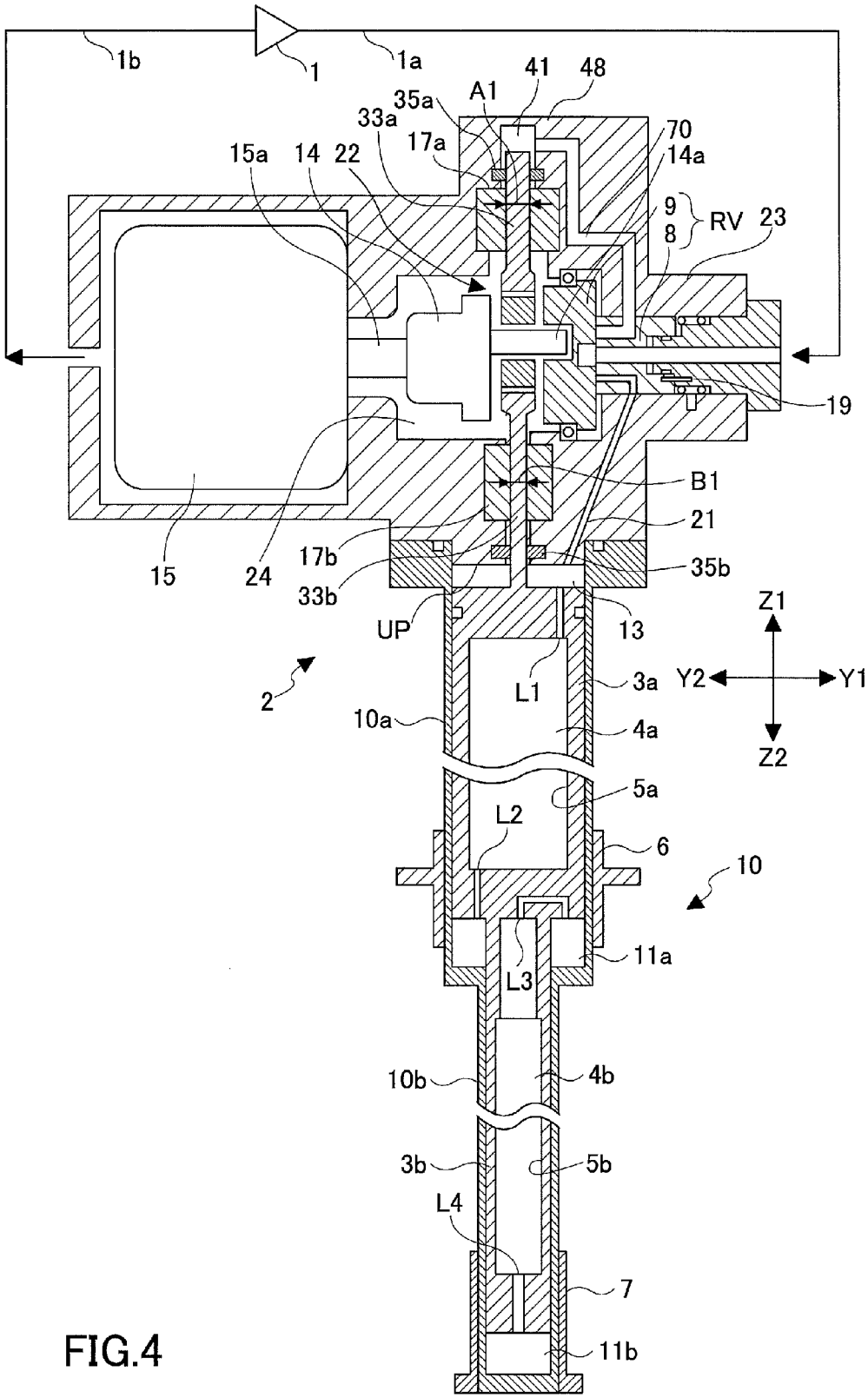
FIG. 4 is a cross sectional view illustrating the GM refrigerator in a modification.

Next, a description will be given of a modification, by referring to FIG. 4. In the embodiment described above, the assist chamber 41 is connected to the supply pipe 1*a* of the gas compressor 1 via the branching pipe 40. On the other hand, in the GM refrigerator in this modification, an assist pipe 70 is used in place of the branching pipe 40. The configuration of other parts of the GM refrigerator in this modification may be the same as those of the embodiment described above. For this reason, a description of the same configuration will be omitted in the following description for simplicity.

The assist pipe 70 connects the rotary valve RV and the assist chamber 41. Further, as the rotary valve RV rotates, the assist chamber 41 selectively communicates to the discharge port and the suction port of the gas compressor 1.

A phase of the repetition of the working gas supply and return operations with respect to the assist chamber 41 is appropriately adjusted to a phase of the reciprocating motions of the first-stage and second-stage displacers 3*a* and 3*b*. For example, when the supply valve V1 opens, the assist chamber 41 is connected to the suction port of the gas compressor 1.

In this state, the assist force F takes a negative value, and thus, acts in a direction to assist the displacer movement. In addition, when the return valve V2 opens, the assist chamber 41 is connected to the discharge port of the gas compressor 1. In this state, the assist force F takes a positive value, and acts in a direction to assist the displacer movement.

Figure 5:
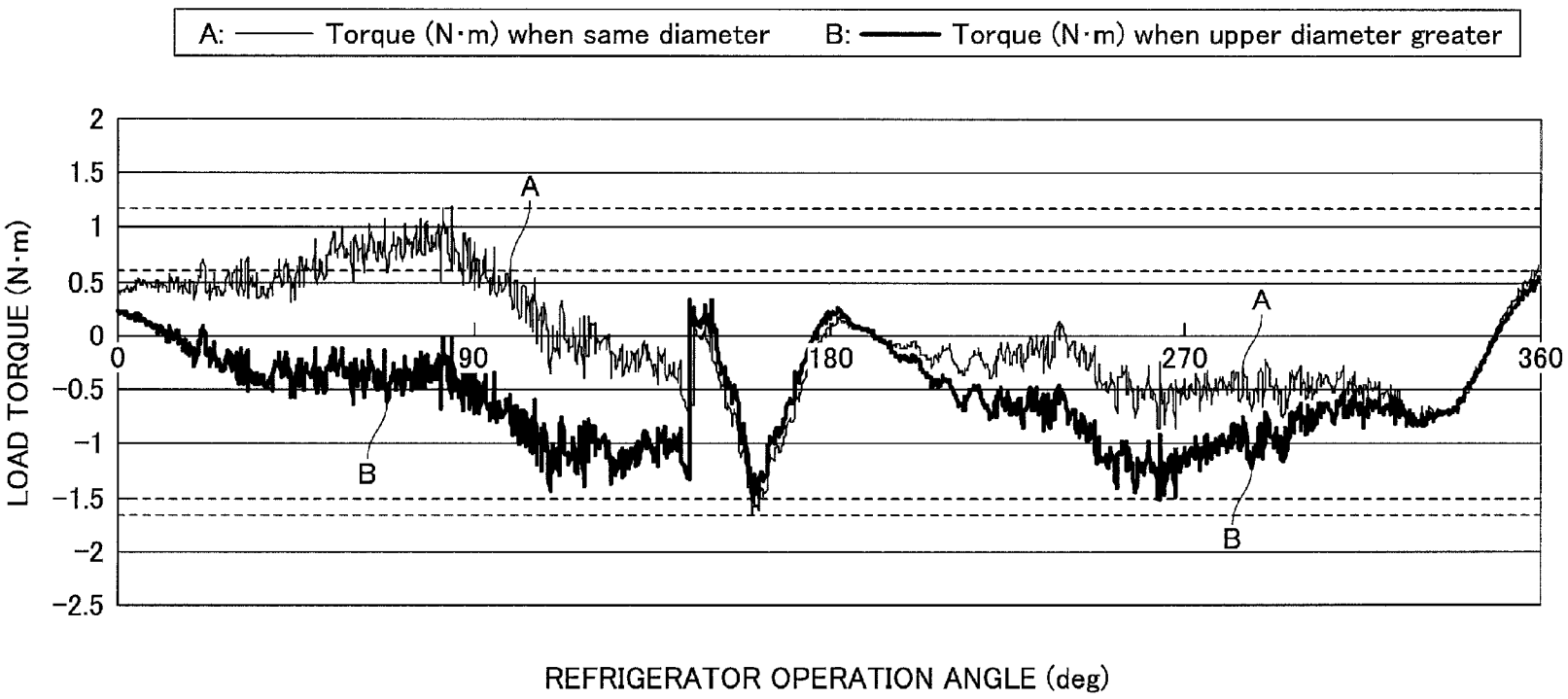
FIG. 5 is a diagram illustrating a load torque versus cryogenic refrigerator operation angle characteristic for a case in which a cross sectional area of an upper drive shaft is large with respect to that of a lower drive shaft, in comparison with a case in which the cross sectional areas of the upper and lower drive shafts are the same.

FIG. 5 is a diagram illustrating examples of the motor load torque applied onto the motor 15 of the GM refrigerator during one cycle of the refrigerator operation, by taking a refrigerator operation angle on the horizontal axis.

In FIG. 5, an arrow A indicates the motor load torque (hereinafter also referred to as a "motor load torque A") of a comparison example in which the diameters (cross sectional areas) of the upper and lower drive shafts 33*a* and 33*b* are the same.

In FIG. 5, an arrow B indicates the motor load torque (hereinafter also referred to as a "motor load torque B") of the GM refrigerator illustrated in FIG. 4 in which the diameter (A1) of the upper drive shaft 33*a* is greater than the diameter (B1) of the lower drive shaft 33*b*.

In FIG. 5, the horizontal axis indicates the refrigerator operation angle (crank angle), and the vertical axis indicates the motor load torque. In addition, the refrigerator operation angle for a case in which the volume of the expansion chamber 11 is a maximum is 0°. The configurations of the GM refrigerators for which the characteristics illustrated in FIG. 5 are obtained are the same except for the configuration of the upper and lower drive shafts 33*a* and 33*b*, and the GM refrigerators are set up vertically with the expansion space facing upwards.

First, the motor load torque B indicated by the arrow B is focused. The motor load torque B corresponds to the load torque characteristic for the case in which the diameter A1 of the upper drive shaft 33*a* is greater than the diameter B1 of the lower drive shaft 33*b* (A1>B1).

In a range in which the operation angle is 0° to approximately 180°, the value of the motor load torque B is smaller compared to the motor load torque A (load torque characteristic in which the diameters of the upper and lower drive shafts 33*a* and 33*b* are the same).

This range, in which the operation angle is 0° to approximately 180°, corresponds to a range in which the volume of the expansion chamber 11 illustrated in FIG. 3 is the maximum to a state where the displacer 3 moves downwards. In this state, the pressure of the working gas flowing within the gas channel 5 acts in the upward direction (direction indicated by the arrow Z1 in FIG. 3).

On the other hand, as described above, in the case in which the diameter A1 of the upper drive shaft 33*a* is greater than the diameter B1 of the lower drive shaft 33*b* (A1>B1), the assist force F caused by the pressure of the working gas supplied to the assist chamber 41 acts in the downward direction (direction indicated by the arrow Z2 in FIG. 3). For this reason, the motor 15 is assisted by the assist force F, and the motor load torque B applied onto the motor 15 is reduced compared to the motor load torque A. Further, in a range in which the operation angle is 180° to approximately 360°, the assist force F acts in the upward direction. Hence, by setting the cross sectional area of the upper drive shaft 33*a* greater than that of the lower drive shaft 33*b*, the motor load torque can be reduced in the range in which the operation angle is 0° to approximately 180° where the motor load torque temporarily increases during one cycle of the refrigerator operation.

Figure 6:
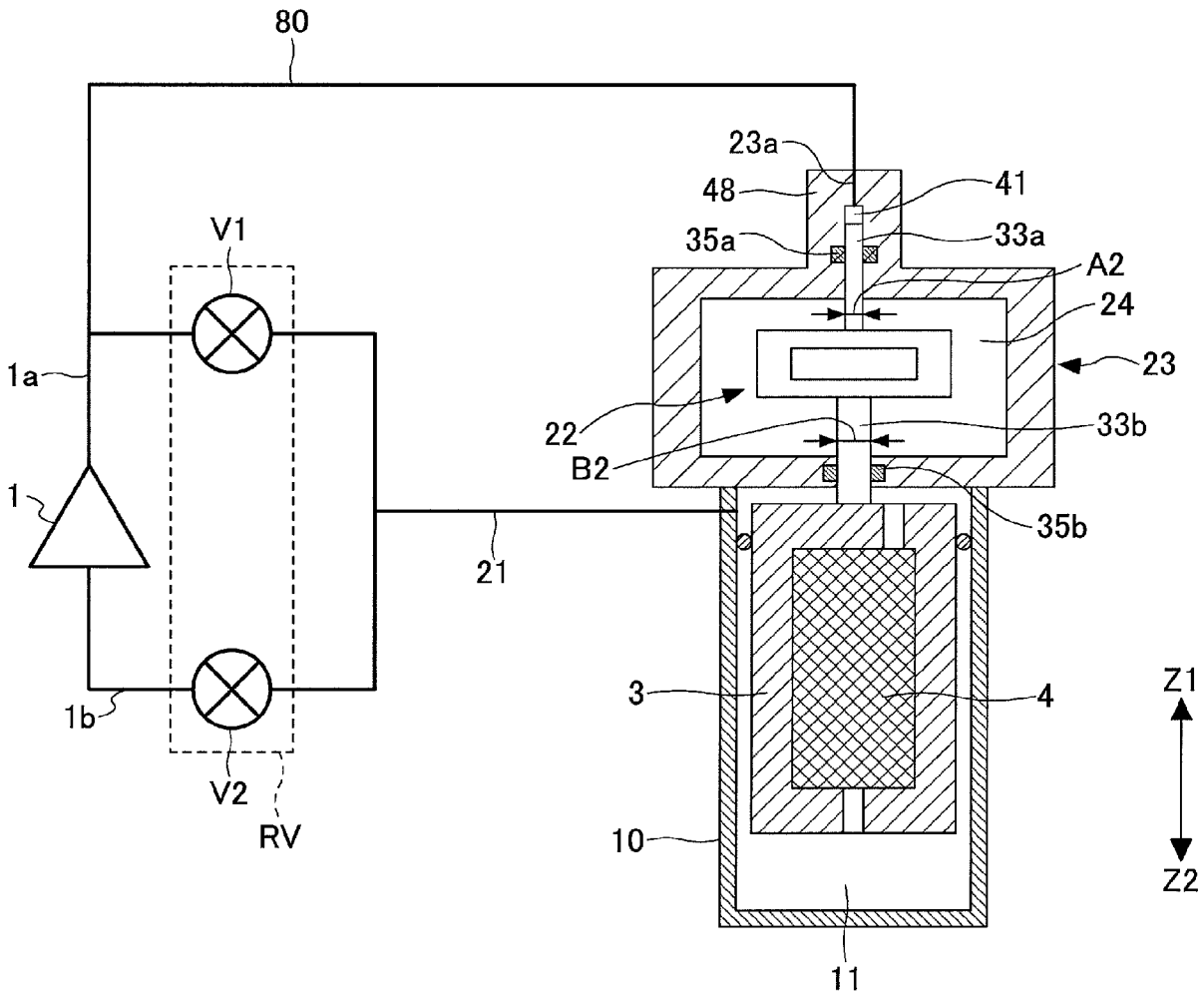
FIG. 6 is a cross sectional view illustrating the GM refrigerator in another embodiment of the present invention.

Next, a description will be given of another embodiment, by referring to FIG. 6.

In FIG. 1, the cross sectional area $S_U$ of the upper drive shaft 33*a* passing through the upper seal 35*a* is set greater than the cross sectional area $S_L$ of the lower drive shaft 33*b* passing through the lower seal 35*b*.

On the other hand, in this other embodiment, the cross sectional area $S_U$ of the upper drive shaft 33*a* passing through the upper seal 35*a* is set smaller than the cross sectional area $S_L$ of the lower drive shaft 33*b* passing through the lower seal 35*b*. In addition, the assist chamber 41 is connected to the suction port of the gas compressor 1 via an assist pipe 80.

The configuration of other parts of the GM refrigerator in this other embodiment may be the same as those of the embodiment described above. For this reason, a description of the same configuration will be omitted in the following description for simplicity.

Figure 7:
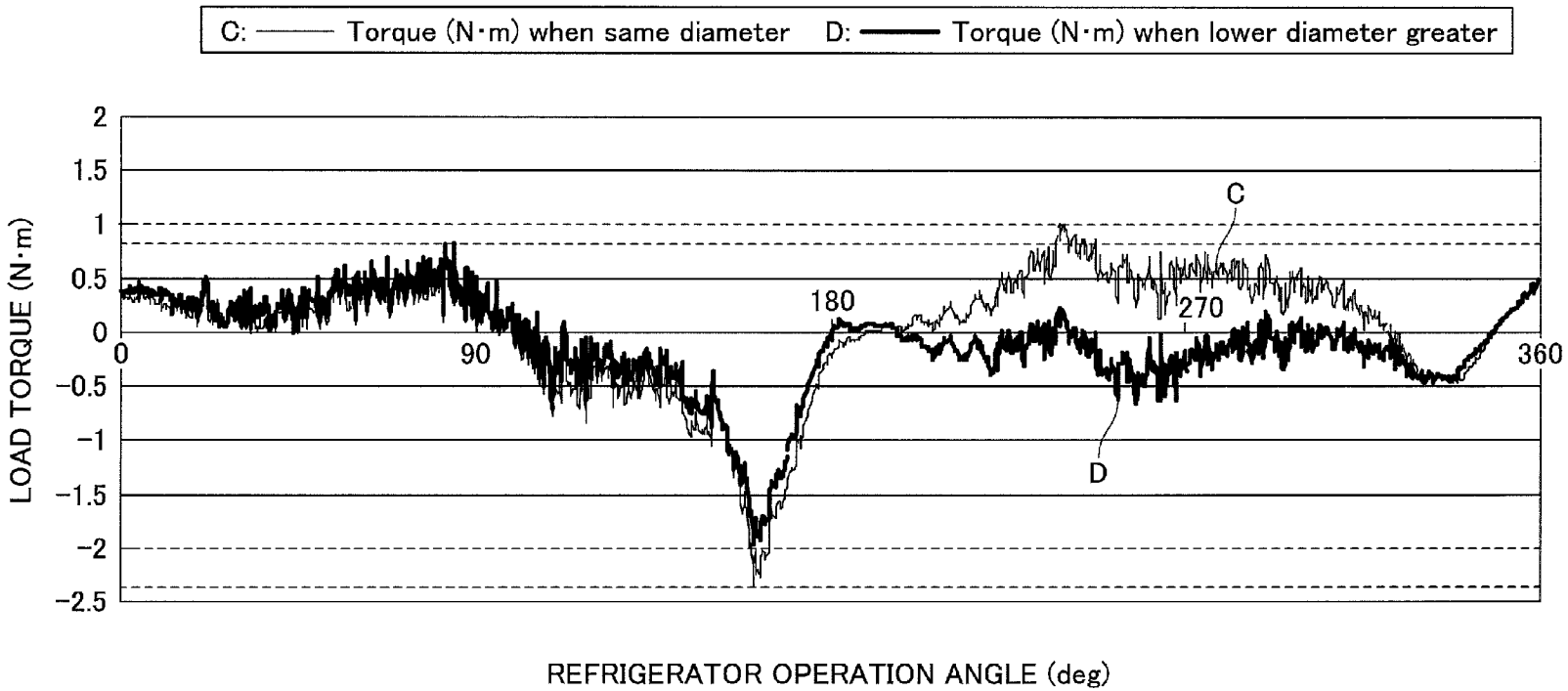
FIG. 7 is a diagram illustrating a load torque versus cryogenic refrigerator operation angle characteristic for a case in which the cross sectional area of the upper drive shaft is small with respect to that of the lower drive shaft, in comparison with the case in which the cross sectional areas of the upper and lower drive shafts are the same.

FIG. 7 is a diagram illustrating examples of the motor load torque applied onto the motor 15 of the GM refrigerator during one cycle of the refrigerator operation, by taking the refrigerator operation angle on the horizontal axis.

In FIG. 7, an arrow C indicates the motor load torque (hereinafter also referred to as a "motor load torque C") of a comparison example in which the diameters (cross sectional areas) of the upper and lower drive shafts 33*a* and 33*b* are the same.

In FIG. 7, an arrow D indicates the motor load torque (hereinafter also referred to as a "motor load torque D") of the GM refrigerator illustrated in FIG. 6 in which the diameter (B1) of the lower drive shaft 33*b* is greater than the diameter (A1) of the upper drive shaft 33*a*.

In FIG. 7, the horizontal axis indicates the refrigerator operation angle (crank angle), and the vertical axis indicates the motor load torque. In addition, the refrigerator operation angle for a case in which the volume of the expansion chamber 11 is a maximum is 0°. The configurations of the GM refrigerators for which the characteristics illustrated in FIG. 7 are obtained are the same except for the configuration of the upper and lower drive shafts 33*a* and 33*b*, and the GM refrigerators are set up vertically with the expansion space facing downwards.

As illustrated in FIG. 7, by setting the cross sectional area of the upper drive shaft 33*a* smaller than that of the lower drive shaft 33*b*, the motor load torque can be reduced in the range in which the operation angle is 180° to approximately 360° where the motor load torque temporarily increases during one cycle of the refrigerator operation.

Therefore, by setting the cross sectional areas of the upper and lower drive shafts 33*a* and 33*b* to be mutually different depending on the refrigerator, the torque required to drive the displacer can be reduced without increasing the size of the structure.

The embodiments and modification described above can thus provide a cryogenic refrigerator that can reduce the torque required to drive the displacer, without increasing the size of the structure.

It should be understood that the invention is not limited to the above-described embodiment, but may be modified into various forms on the basis of the spirit of the invention. Additionally, the modifications are included in the scope of the invention.

What is claimed is:

1. A cryogenic refrigerator comprising:

a compressor having a return end and a suction end that selectively connects to an expansion space;

a housing having an assist space that communicates to the return end;

a cylinder having one end connected to the housing and another end connected to the expansion space;

a displacer that undergoes a reciprocating motion inside the cylinder, and tolerates flow of a working gas to and from the expansion space via a gas channel provided inside the displacer; and a drive shaft that extends in an axial direction and is accommodated within the housing and drives the displacer, wherein the drive shaft includes a first shaft part that extends in the axial direction and is sealed and supported by a first seal member that is formed by a slipper seal, and a second shaft part that extends in the axial direction and is sealed and supported by a second seal member, the first shaft part having an end opposing the housing to form the assist space, the second shaft part having an end connecting to the displacer, and wherein a first cross sectional area of the first shaft part passing through the first seal member and a second cross sectional area of the second shaft part passing through the second seal member are mutually different.

2. The cryogenic refrigerator as claimed in claim 1, wherein the first cross sectional area of the first shaft part passing through the first seal member is greater than the second cross sectional area of the second shaft part passing through the second seal member.

3. The cryogenic refrigerator as claimed in claim 1, wherein the first seal member seals and isolates a space that constantly communicates to the suction end of the compressor, and the assist space.

4. The cryogenic refrigerator as claimed in claim 1, wherein the second seal member seals and isolates a space that constantly communicates to the suction end of the compressor, and an internal space inside the cylinder.

5. The cryogenic refrigerator as claimed in claim 1, wherein the first cross sectional area of the first shaft part passing through the first seal member is smaller than the second cross sectional area of the second shaft part passing through the second seal member.

6. The cryogenic refrigerator as claimed in claim 1, wherein the first shaft part and the second shaft part of the drive shaft extend coaxially along the axial direction of the drive shaft.

7. The cryogenic refrigerator as claimed in claim 1, wherein an assist force that assists a movement of the displacer is adjustable by the first cross sectional area of the first shaft part passing through the first seal member and the second cross sectional area of the second shaft part passing through the second seal member.

8. The cryogenic refrigerator as claimed in claim 1, further comprising:

a drive mechanism provided within a drive mechanism accommodating chamber that is formed in the housing, wherein the drive mechanism drives the displacer, wherein the drive mechanism accommodating chamber communicates to the suction end of the compressor via a return pipe, and wherein an assist force that assists a movement of the displacer is adjustable by the first cross sectional area of the first shaft part and the second cross sectional area of the second shaft part, without changing each of an assist space pressure of the assist space supplied with the working gas from the compressor, a housing chamber pressure of the drive mechanism accommodating chamber, and a cylinder internal pressure inside the cylinder.

* * * * *